US006986243B2

(12) United States Patent
Bell et al.

(10) Patent No.: US 6,986,243 B2
(45) Date of Patent: Jan. 17, 2006

(54) DEVICE FOR PROCESSING CONTINUOUSLY FORMED GOODS

(75) Inventors: Bertram Bell, Kerpen-Buir (DE); Helmut Lämmermann, Schwabach (DE)

(73) Assignee: Maschinenfabrik Niehoff GmbH & Co. KG, Schwabach (DE)

( * ) Notice: Subject to any disclaimer, the term of this patent is extended or adjusted under 35 U.S.C. 154(b) by 131 days.

(21) Appl. No.: 10/718,994

(22) Filed: Nov. 21, 2003

(65) Prior Publication Data

US 2005/0092866 A1 May 5, 2005

(30) Foreign Application Priority Data

Nov. 22, 2002 (DE) ..... 102 54 643

(51) Int. Cl.
*B65H 57/00* (2006.01)

(52) U.S. Cl. ..... 57/352; 57/90

(58) Field of Classification Search ..... 57/90, 57/91, 281, 112, 352; 226/168, 178, 180, 226/188, 189

See application file for complete search history.

(56) References Cited

U.S. PATENT DOCUMENTS 4,120,139 A * 10/1978 Terasawa et al. ..... 57/13
4,220,274 A * 9/1980 Schubert et al. ..... 226/34
4,930,415 A * 6/1990 Hara et al. ..... 101/228

FOREIGN PATENT DOCUMENTS

DE 3341986 A1 * 5/1985

* cited by examiner

*Primary Examiner*—John J. Calvert
*Assistant Examiner*—Shaun R. Hurley
(74) *Attorney, Agent, or Firm*—Greer, Burns & Crain, Ltd.

(57) ABSTRACT

An apparatus and a method for processing string materials, particularly electric conductors, includes at least one first string material guide for conveying the string material along a path of movement to a processing apparatus and including at least one second string material guide located between the first guide and the processing apparatus. The first guide means further includes at least one guiding element by which self-twisting of the string material about the longitudinal axis thereof may at least be impeded. The second string material guide includes another guiding element which is rotationally positioned about an axis arranged at a given angle with regard to the path of movement and is driven by a driving apparatus. The guiding elements are rotated either continuously or intermittently.

24 Claims, 3 Drawing Sheets

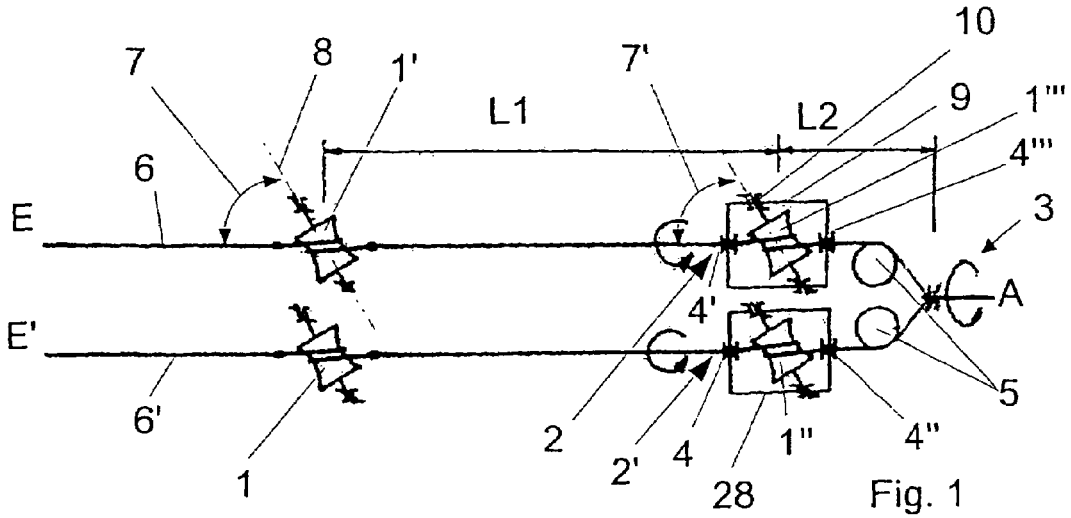
Fig. 1
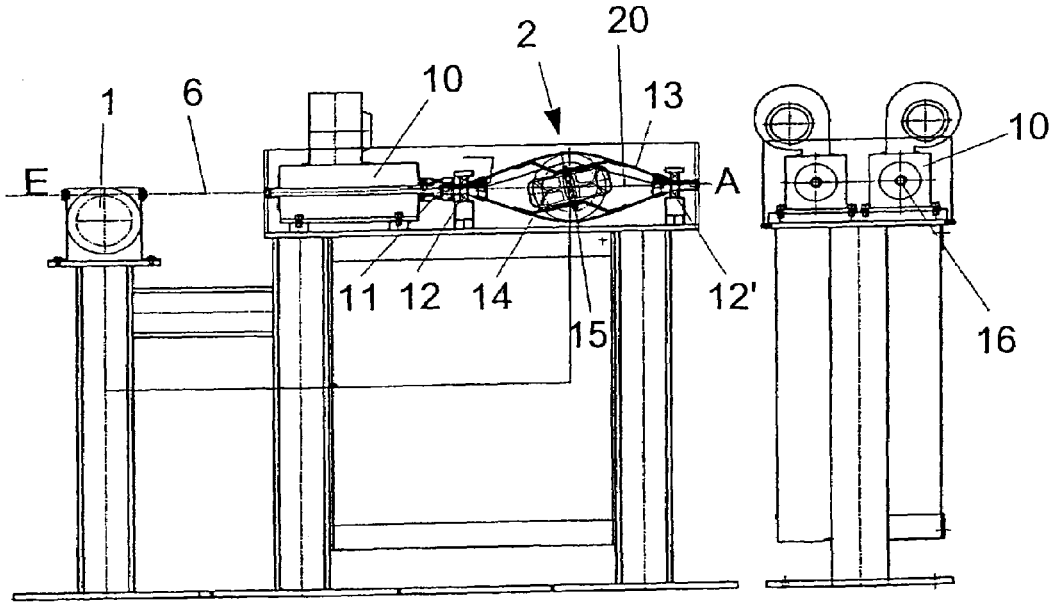
Fig. 2a
Fig. 2b

DEVICE FOR PROCESSING CONTINUOUSLY FORMED GOODS

The present invention relates to an apparatus and a method for processing string materials, particularly electric conductors.

Although the present invention has particularly been described with regard to the manufacture of insulated electric conductors, it is not restricted thereto and may also be used for other string materials.

The increased use of the internet and the need for rapid transmission of larger data sets demands for novel and improved standards for the manufacture of data transmission lines, particularly with regard to improved electric properties of conductors.

Due to this improvement of the electric properties of data transmission lines, manufacturers of these lines are forced to permanently improve their methods and devices for the production of data transmission lines, to reach not only improved quality standards but also an economical production.

Apart from the essential properties of the materials, researches are concerned with the manufacturing process of twisted line elements as well as of line groups, to obtain the tolerances for lines and cables as they are required for high-frequency signal transmission.

In this connection, backtwisting may be mentioned, among other things, which allows to use a more generous range of manufacture, particularly as concerns the concentricity of the cable leads with regard to the outer insulation.

Impedance and/or structural reflectance filtration are influenced, among other things, by concentricity in case of high-frequency signal transmission.

However, it has to be taken into account that backtwisting improves the line properties caused by eccentricity, but cannot reduce the influence of other process values, such as variable line or insulation diameters.

It is the object of the present invention to provide an apparatus and a method for processing string materials according to which, if compared to the prior art devices, a more simple, inexpensive and reliable influence of string material twisting can be obtained.

This object is solved by the apparatus according to claim 1. The inventive method is the subject matter of claim 20. Preferred embodiments of the apparatus and the method are subject matters of the sub-claims.

The inventive apparatus includes a first and a second string material guiding means located in a path of transportation before entering into a processing means.

Both string material guiding means comprise at least one first and one second guiding elements by which self-twisting of the string material is influenced. The string material is either continuously or intermittently transported through this guiding means. While the transportation means is either running or standing still, the second guiding element is twisted. Twisting said second guiding element causes self-twisting of the wire. This twisted or drilled string material will then be supplied to the processing apparatus.

Owing to the inventive apparatus and method it has thus become possible to twist the string material by use of simple means and to process the string material in its twisted shape.

Depending on the chosen parameters, i.e. conveying speed or tuning of conveyor stop and twisting, rotational speed of the second guiding element etc., the string material may be influenced in such a manner that it is either no longer twisted after processing, or is twisted in positive direction (which corresponds to the right-hand-rule), or that it is twisted in negative direction.

For the manufacture of data transmission cables as mentioned above self-twisting is preferred, particularly in order to prevent any data transmission faults caused by an eccentric arrangement of the electric conductor within its insulation.

The inventive apparatus for processing string materials comprises at least one first string material guiding means by which the material is guided to a processing means through at least one first path of transportation. This first guiding means includes at least one guiding element by which self-twisting of the string material about the longitudinal axis thereof may be impeded, for example before and/or after torsion or twisting has taken place.

According to the present invention, impediment of self-twisting means that the transmission of torsional strengths beyond a given point may be reduced or preferably largely or entirely prevented.

According to a particularly preferred embodiment, the first guiding element of said first guiding means may be a rotationally positioned drum, roller, or the like.

According to a particularly preferred embodiment, said first and/or second guiding elements are of a cross-sectional outer contour that changes, at least section-wise, along the center line.

According to a particularly preferred embodiment, said guiding element is of a diameter diminishing from both outer sides towards the inside, wherein the outer contour continuously changes along the rotational axis.

According to another embodiment, the diameter of said first and/or second guiding elements may be constant along the rotational axis.

According to the present invention, the different configuration of said guiding element of said first or said second guiding means is selected depending on the desired guide control of the string material to which a torsion has to be applied, wherein apart from twisting further parameters such as the path of transportation are also taken into consideration.

According to the present invention, the term "string material" is to be understood as a material of substantially one-dimensional direction of extension. These string materials may be, for example, round-edged wires, flat wires, profiled wires, hollow wires in stranded or similar form made of most different materials such as steel, aluminum, brass, copper and other metals, textiles, optical fibers, and the like. The string material may consist of one or several materials and may particularly be insulated.

The apparatus by which a torsion is applied to string materials further comprises at least one second string material guiding means which may be arranged, for example, between a first guiding means and a processing means.

According to the present invention it is, however, also conceivable to arrange said second string material guiding means between two first guiding means, or to realize said first guiding means in that a processing means has been added before said second guiding means so that said first guiding means becomes superfluous. The first guiding means may be omitted, particularly if a processing means added in the direction of movement, e.g. such as a wire take-off station, a wire drawing means, or an extrusion means, is of such a kind or is changed in such a manner that self-twisting of the wire beyond this processing means is impeded or avoided, if seen against the direction of movement of the string material.

Correspondingly, the same also applies—depending on the individual application—to a processing means added behind.

According to the present invention, processing means may either be, for example, twisting machines, spinning machines, stranding machines, or the like.

The second string machine guiding means further comprises at least one guiding element rotationally positioned about at least one first axis and being of a given angle to the path of movement with regard to its rotational axis.

The second guiding means further comprises a drive means for rotation of the guiding element.

According to the present invention, the drive means comprises a motor, particularly an electric motor with hollow shaft, or a motor with belt drive. Preferably, torque is transmitted via a coupling element which is preferably fixedly connected to the rotationally positioned body of the second string material guiding means.

According to a particularly preferred embodiment, said second string material guiding means comprises a body rotationally positioned about an axis and including at least one inlet and outlet area. There is provided at least one guiding means within this body, wherein the rotational axis thereof is of an angle preferably larger than 0° with regard to the path of movement.

According to a particularly preferred embodiment, said angle is of a value ranging between 0° and 90°, preferably between 45° and 90°, and more preferably between 70° and 90°.

According to a particularly preferred embodiment, the rotation of the guiding element about said second axis of said second string material guiding means is particularly used for the transportation of string material along said predetermined path of movement which is determined by the position of the guiding means and particularly the guiding elements relative to one other.

According to an inventive embodiment, further at least one guiding element is positioned in such a manner that it may rotate about two axes.

This bivalent rotation of the guiding element does not only allow a transportation of the string material as described above, but also a rotation about the longitudinal axis of the string material and, thus, applying torsion thereto.

According to a particularly preferred embodiment, the enclosed angle of said first axis of said second string material guiding means and the path of movement of the string material is between 0° and 90°, 0° and 45°, preferably between 0° and 25°, and 0° and 5°, and most preferably approximately or exactly 0°.

The orientation of the rotational axis with regard to the path of movement of the string material results in that the axis may, for example, either be vertical to said path of movement, or, according to a particularly preferred embodiment, parallel or approximately parallel to said path of movement.

Furthermore, the distance between the inlet and outlet area of said second string material guiding means and the respective first string material guiding means may be changed, according to a particularly preferred embodiment, either continuously or intermittently.

According to the present invention, intermittently means that this change takes place alternating, not continuous or with interruptions.

According to a particularly preferred embodiment, the distance between the inlet area of said second string material guiding means and said first string material guiding means and the distance between the outlet area of said second string material guiding means and another first string material guiding means is of a special ratio.

According to an inventive embodiment, this ratio may be of a value greater one, wherein this value may be selected from two first guiding means in the apparatus, particularly in dependency of the torsion storage volume of the string material.

According to a particularly preferred embodiment, the inner contour of the inlet and the outlet areas of said second string material guiding means is, at least section-wise, parallel to the course of the path of movement of the string material. Due to this shape, particularly the abrasion in the inlet or outlet area can be reduced and, thus, the availability, i.e. the service life of the apparatus for processing string material can be improved.

According to a particularly preferred embodiment, the string material guiding means and particularly also the guiding elements comprise at least one material from the group of materials including not only metals such as aluminum, copper, steel, but also metal alloys such as bronze, aluminum alloys and plastics such as thermoplastics or duroplastics, but also optical fibers, reinforced plastics and composite materials as well as synthetic and natural resins.

Apart from the materials mentioned above, it is also the purpose of the present invention to use alternative materials which may be used, due to their properties concerning density and strength, for larger accelerations or in an apparatus used to apply a torsion to string materials.

According to a particularly preferred embodiment of the present invention, the position of the rotational axis of the guiding elements may be changed in a manner that different angles are set between the path of movement of the string material and the guiding elements.

According to a particularly preferred embodiment, three guiding elements are rotationally positioned in said first rotationally positioned body of said second string material guiding means comprising at least one inlet and one outlet area.

According to said embodiment, a path of movement of the string material is provided between the inlet and the outlet area of said second string material guiding means, said path alternatively running either above or below the correspondingly preceding or following rotational axis of a guiding element.

The result is, according to the above-described embodiment, a guided connection between guiding element and string material enabling the transmission of a torsional force and, thus, twisting of the string material about its longitudinal axis.

The object of the invention is further solved by a method for applying a torsion to string material, particularly electric conductors, according to claim 20. The sub-claims relate to preferred embodiments of the present invention.

The method refers to the transportation of the string material along at least one first path of movement to a processing means.

This processing means may be, e.g., a rope means used to twist, for example, two electric conductors to which a torsion has been applied before, to form an electric pair of conductors.

Furthermore, according to the inventive method, the self-twisting of the string material about its longitudinal axis is at least partially impeded by means of at least one guiding element of a first string material guiding means.

According to a particularly preferred embodiment of the present invention, one guiding element is provided before and one guiding element is provided behind said second string material guiding means, wherein alternative functional means such as guiding elements may be provided that have to be assigned to a following or preceding method step and may be used to impede self-twisting of the string material about the longitudinal axis thereof.

In addition to the transportation and impediment of self-twisting, a torsion is applied to the string material, according to the inventive method, by at least one guiding element of a second guiding means. This application of torsion is done about a first axis that is of a given angle with regard to the path of movement.

According to a particularly preferred inventive embodiment, the path of movement is that one determined by the guidance of the string material by means of the string material guiding means and particularly the guiding elements.

For example, this path of movement has been defined by the inlet and the outlet areas of said second string material guiding means.

Furthermore, the method according to the present invention includes a drive means to rotate the guiding element of said second string material guiding means about the first axis.

According to another preferred embodiment of the method for processing string material, the rotation of the guiding element of said second string material guiding means is continuous.

According to another embodiment, the rotation is intermittent, wherein the string material transported, for example, between two first string material guiding means, has been applied by a given number of rotations which results in that the wire, when removed from the inventive apparatus, is of a particularly uneven torsion with regard to entire way of removal.

According to another inventive embodiment, the control of said rotation of the guiding element which results in applying a torsion to the string material is particularly determined in dependency of the conveyor speed of the string material and a degree of torsion that might, for example, be given by a processing step to follow later.

According to a preferred inventive embodiment, the degree of torsion is determined particularly under consideration of the following step of wire twisting, in order to avoid, for example, twitting of an electric conductor in the next processing step.

For example, twitting of electric conductors may result in that the insulation is removed from the conductor material, e.g. copper wire, and in signal transmission interferences, particularly in case of higher frequencies.

Furthermore, applying a torsion to the insulated cable changes the position of the cable within the insulation, particularly as concerns the concentration. This is particularly used to balance the position of, for example, two subsequently twisted conductors or the conductive material thereof relative to one other so that regularly repeating deviations may be reduced that might cause an effect for example on the electric capacity between two conductors.

According to a preferred embodiment, the distance between said first string material guiding means and said second string material guiding means is changed either continuously or intermittently.

In this connection, particularly at least one of said first string material guiding means is movably positioned with regard to said second string material guiding means so that, depending on the speed of removal and/or speed of transportation of the string material and/or a desired backtwisting of the conductor, the distance between said two guiding means is changed.

Further advantages, features and possible applications of the present invention can be learned from the following description, in combination with the drawings, wherein:

FIG. 1 is a schematic view of an apparatus for applying a torsion to string material according to the present invention;

FIG. 2 is a schematic side view of a preferred embodiment of the apparatus for applying a torsion to string material according to the present invention;

FIG. 2*b* is a left side view of the schematic representation of FIG. 2*a;*

Figure 3A:
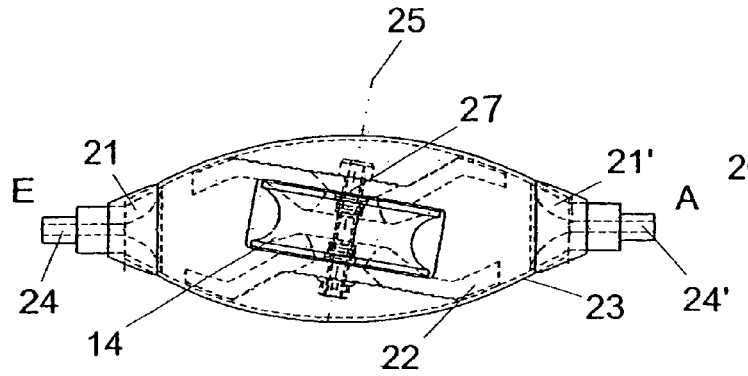
Figure 3B:
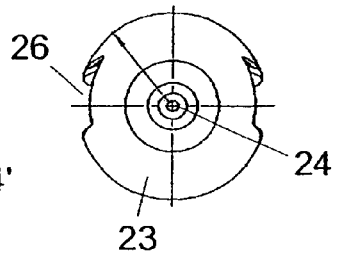

FIG. 3*a* is a schematic view of an embodiment of a second string material guiding means according to the present invention;

FIG. 3*b* is a side view of said second string material guiding means of FIG. 3*a;*

Figure 3C:
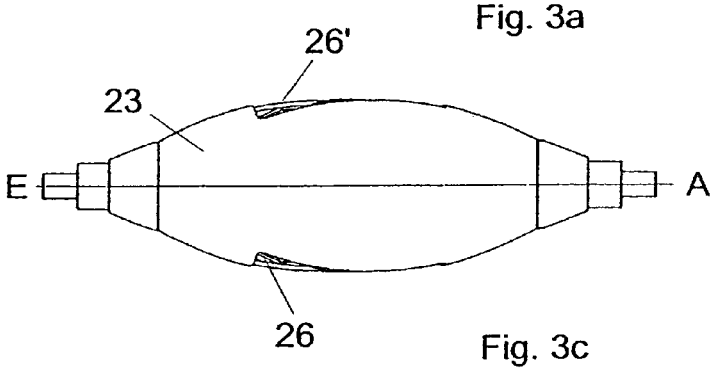

FIG. 3*c* is a plan view of said second string material guiding means of FIG. 3*a;*

Figure 3D:
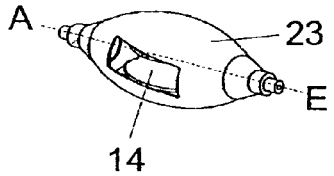

FIG. 3*d* is a perspective view of said second string material guiding means of FIG. 3*a;*

Figure 4:
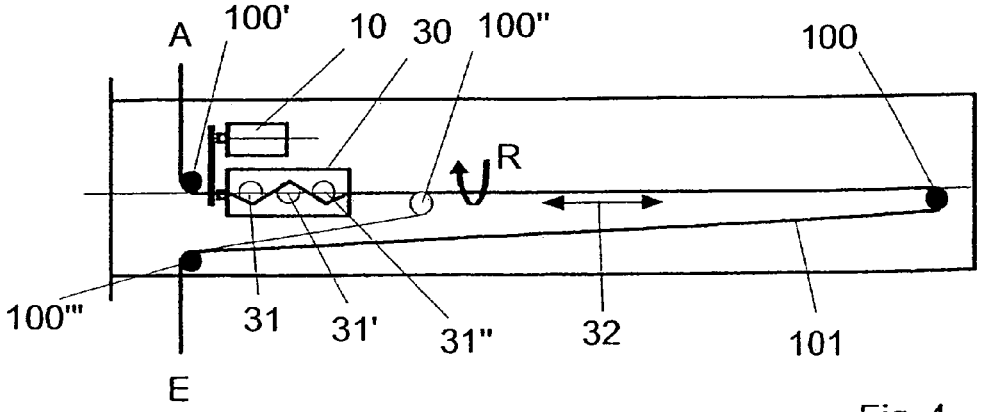
Figure 5:
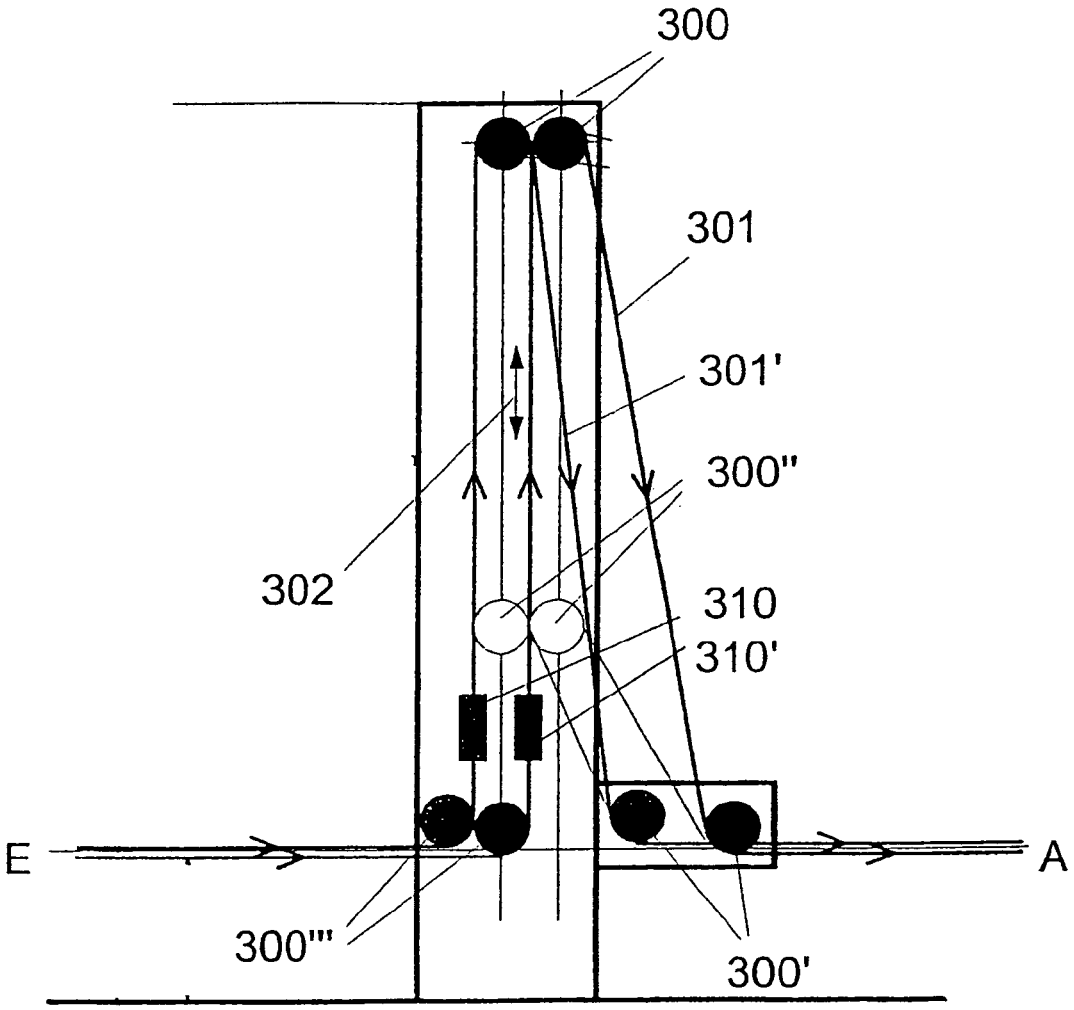

FIG. 4 is a schematic view of another preferred embodiment of an apparatus for applying a torsion to string material according to the present invention;

FIG. 5 is a schematic view of an alternative embodiment of an apparatus for applying a torsion to two electric conductors, for example.

FIG. 1 is a schematic view of an apparatus for applying a torsion to string material according to the present invention, in which the string material extends along the line 6 and 6' from an inlet E to an outlet A. According to this embodiment, two inventive devices for applying a torsion to string material are arranged in parallel and are used, together with a guiding element 3 arranged at a given distance L2 from said second guiding means, to combine the two string materials. For example, as indicated by the arrow, the conductors will be twisted to form an electric pair. According to the present invention, the guiding elements 1, 1' and 3 form so-called string material guiding means by which self-twisting of the string material about its longitudinal axis may at least be impeded.

According to the shown embodiment, these guiding elements may either be a rotationally positioned drum, roller, etc. around which the string material is guided circumferentially, for example, once.

Among other things, torsional strengths cause that self-twisting of the string material is at least partially impeded, wherein the rotation of this guiding element about rotational axis 8 causes that the string material is transported along a path of movement.

Rotational axis 8 is orientated at a given angle 7 which is, according to the present invention, between 0° and 90°, preferably between 45° and 90° and most preferably between 65° and 90°.

Behind this guiding element another string material guiding means 9 comprising inlets 4 and 4' and outlets 4" and 4'" is provided at a given distance L1.

Furthermore, the guiding elements 1" and 1'" are rotationally positioned within a body 28 of said second string material guiding means 9, wherein the body 28 of said second string material guiding means includes, according to this embodiment, another rotational axis parallel to the path of movement 6, 6' of the string material.

Due to this arrangement, first rotational axes 2 and 2' are provided for said second string material guiding means which are, according to the embodiment as shown, approximately parallel to the path of movement 6. The second rotational axis 10 is arranged, according to this embodiment, at a given angle 7' with regard to the path of movement 6.

According to the embodiment as shown, guiding elements 1" and 1'" are substantially used to guide the string material along a given path of movement, wherein the eccentric guidance of the string material by means of guiding elements 1" and 1'" causes that a torsion is applied to the string material due to the rotation of said second string material guiding element, particularly of body 28 of said second string material guiding means, about the rotational axis 2 and 2' arranged approximately parallel to the path of movement. The outlet areas 4" or 4'" are followed, according to the embodiment, by deflection rollers 5, respectively, used to supply the string material to said guiding means 3 and arranged at a distance L2 to said guiding element of said second string material guiding means.

According to the present invention, said second string material guiding means generates a certain torsion at its inlet which is proportional to the speed of said second string material guiding means and vice versa proportional to the removal speed of the string material from the apparatus.

A corresponding torsion is generated at the outlet of said second string material guiding means, however, the direction of rotation thereof being orientated vice versa. Hence, the rotation of said second string material guiding means creates a torsion resulting from the torsion before said second string material guiding means and behind said second string material guiding means. It is also independent of the distances between said second string material guiding means and said first string material guiding means, respectively.

In order to obtain backtwisting or a so-called stranding effect, the above-described first string material guiding means are necessary which, among other things, causes that an expansion, for example into the direction of the inlet, of the torsion applied by said second string material guiding means may be avoided as so-called torsional barrier. According to a particularly preferred embodiment, said first string material guiding means is stationary and can be adapted corresponding to the intended purpose of the product to be processed.

These may be, for example, products to be backtwisted with a roll, or products to be stranded with a perforated disk and/or strand nipples.

According to the present invention, said second string material guiding means for generating said backtwisting and/or stranding is either accelerated or decelerated by means of a drive means. This process is repeated in dependency of the withdrawal speed and the time the string material needs to run through the apparatus.

According to the present invention, the string material acts like a torsion storage means, as the rotation applied between said two first string material guiding means by said second string material guiding means is accepted. However, torsion must not be continuous and will be reduced again in the above-described region, for example, by means of a continuous speed of removal for the string material from the apparatus.

According to a particularly preferred inventive embodiment, the rotation of the string material preferably takes place in one direction. It is, however, also within the sense of the present invention that the rotation may also be reversed by use of a corresponding drive means.

FIG. 2*a* is a side view of another embodiment of an apparatus for processing string material, wherein the string material is guided along the path of movement 6 from region E into the apparatus and beyond region A out of the apparatus. Reference number 1 refers to a first guiding element of said first guiding means by which self-twisting of the string material can be avoided as so-called torsional barrier. The string material is supplied to the second string material guiding element via a hollow shaft 10, wherein guiding element 14 is rotationally positioned within body 13. Body 13 of said second string material guiding element is, according to the embodiment as shown, of a basic spindle-shaped structure, both ends thereof being rotationally fixed by bearings 12 and 12'. The body 13 is fixedly connected to a drive means by coupling 11.

Due to this arrangement, a torsion is applied to the string material along rotational axis 20 which, according to this embodiment, is approximately parallel to the path of movement of string material 6. Guiding element 14 is located within body 13 and includes a rotational axis 15 arranged at a given angle 7 (see FIG. 1) with regard to the path of movement of string material 6.

FIG. 2*b* is a side view of the apparatus of FIG. 2, wherein not only the passageway of hollow shaft 16 but also the drive means 10 can be seen.

FIGS. 3*a*, 3*b*, 3*c* and 3*d* are different views of the body of a second string material guiding means, wherein FIG. 3*a* indicates a sectional representation of said guiding means. The string material enters the body 23 through the area 24, for example, winds round guiding element 14 and then leaves the body 23 through area 24'.

According to a particularly preferred embodiment, the inlet area E and the outlet area A have contour regions 21 and 21' which are, at least section-wise, parallel to the path of movement of the string material in this region.

Guiding element 14 is positioned along rotational axis 25 and is connected to said body 23 by fastening elements 27.

FIG. 3*b* is a left side view of the body of said second string material guiding means, wherein not only the recesses 26, but also the wall of body 23 and the opening 24 through which the string material runs are shown.

According to the present invention, recesses 26 of body 23 are used to make the guiding elements 14 available, e.g. to an operator, to start the transport of the string material.

FIG. 3*c* is a plan view of the body of a second string material guiding means, wherein not only the inlet area E but also the outlet area A can be seen. Areas 26 and 26' again refer to the recesses used to reach guiding element 14.

FIG. 3*d* is a perspective view of the body of a second string material guiding means, wherein also not only the inlet E but also outlet A and the outer contour of the body 23 and said guiding element 14 can be seen.

FIG. 4 shows an alternative embodiment of an apparatus for applying a torsion to the string material in which, for example, the string material enters the apparatus via area E and leaves it via area A. The string material is conducted along the path of movement which has been given reference number 101 by means of guiding elements 100, 100', 100" and 100'". According to this embodiment, guiding element 100 can be moved in longitudinal direction with regard to the path of movement, as indicated by the double arrow 32. This particularly serves to vary the length ratio between the inlet of said second guiding means and said first guiding element and the outlet of said second guiding means and said outlet.

According to a particularly preferred embodiment, FIG. 4 shows an alternative embodiment for a second string material guiding means including three guiding elements 31, 31' and 31" and body 30. The string material is alternatively conducted behind the inlet area either above or below the rotational axis of guiding elements 31, 31' and 31" and leaves said second string material guiding means in the direction of a first string material guiding means 100'. The second string material guiding means 30 is driven by said drive unit 10 about a rotational axis which is approximately parallel to the path of movement of the string material. Thus, a torsion has been applied to the string material, as indicated by arrow R, between the two guiding elements 100 and 100'.

FIG. 5 shows another embodiment of an apparatus for applying a torsion to string material, wherein, according to this embodiment, a torsion has been applied to two string materials such as electric conductors in parallel and may be twisted, for example, relative to one other in a following processing means (not shown).

According to the embodiment of an apparatus for applying a torsion to a string material as shown in FIG. 4, the apparatus according to FIG. 5 includes guiding elements 300 which may be moved along double arrow 302 parallel to the path of movementn301, 301'.

The second string material guiding means given reference numbers 310 and 310' do not only include the guiding elements but also the rotationally positioned body for applying a torsion to the string material.

Guiding elements 300' and 300" (300" indicating the position of guiding element 300 after being moved along double arrow 302) are substantially used not only to conduct the string material but also to impede self-twisting of the string material about the longitudinal axis thereof. According to a particularly preferred embodiment, the apparatus may either be arranged horizontally or vertically. This particularly meets the requirements concerning flexible mounting of the apparatus, for example in case of later upgrading of an already existing processing apparatus.

What is claimed is:

1. An apparatus for processing string materials, particularly electric conductors, comprising:

at least one first string material guiding means by which the string material is conveyed to a processing means along at least one path of movement;

at least one second string material guiding means arranged along said at least one path of movement between said at least one first string material guiding means and said processing means;

wherein said at least one first string material guiding means includes at least one first guiding element by which self-twisting of the string material about a longitudinal axis thereof may at least be impeded;

wherein said second string material guiding means includes at least one second guiding element which can be rotated about a first axis and is provided at a given angle with regard to said at least one path of movement; and wherein said at least one second string material guiding means further includes a drive means for rotating said at least one guiding element about said first axis.

2. The apparatus for processing string materials as set forth in claim 1, wherein said at least one first and/or second guiding element is a rotationally positioned body which can be rotated about a rotational axis thereof.

3. The apparatus for processing string materials as set forth in claim 2, wherein a diameter of said at least one first and/or second guiding element changes along said rotational axis.

4. The apparatus for processing string materials as set forth in claim 2, wherein a diameter of said at least one first and/or second guiding element remains constant along said rotational axis.

5. The apparatus for processing string materials as set forth in claim 1, wherein said at least one path of movement is determined by a position of said at least one first and/or second string material guiding means and particularly said at least one first and/or second guiding elements relative to one other.

6. The apparatus for processing string materials as set forth in claim 1, wherein said at least one guiding element of said second string material guiding means is rotationally positioned about two axes.

7. The apparatus for processing string materials as set forth in claim 1, wherein said two axes of said one second guiding element enclose an angle ranging between 0° and 90°, preferably between 45° and 90°, and most preferably between 65° and 90°.

8. The apparatus for processing string materials as set forth in claim 1, wherein said at least one second string material guiding means includes a body rotationally positioned about said first axis and comprising at least one inlet and one outlet area in which said at least one second guiding element of said at least one second string material guiding means is located.

9. The apparatus for processing string materials as set forth in claim 1, wherein said rotational axis of said at least one second guiding element is of an angle larger than 0° with regard to said at least one path of movement.

10. The apparatus for processing string materials as set forth in claim 1, wherein an angle between said first axis and said at least one path of movement ranges between 0° and 90°, preferably between 0° and 25°, between 0° and 5° and most preferably between 0°.

11. The apparatus for processing string materials as set forth in claim 1, wherein a rotary movement of said rotationally positioned body of said at least one second string material guiding means is effected by a drive means either continuously or intermittently.

12. The apparatus for processing string materials as set forth in claim 1, wherein said drive means is a motor, particularly an electric motor including a hollow shaft, or a motor including a belt drive, which is connected to said rotationally positioned body of said at least one second string materials guiding means by means of a coupling element.

13. The apparatus for processing string materials as set forth in claim 1, wherein a distance between said inlet and/or outlet area of said at least one second string material guiding means and said at least one first string material guiding means is changed either continuously or intermittently.

14. The apparatus for processing string materials as set forth in claim 1, wherein a distance between the inlet area of said at least one second string material guiding means and said at least one first string material guiding means and a distance between said outlet area of said at least one second string material guiding means and said at least one first string material guiding means is of a given ratio.

15. The apparatus for processing string materials as set forth claim 1, wherein an inner contour of said inlet and outlet area of said at least one second string material guiding means is, at least section-wise, substantially parallel to a course of at least one path of movement.

16. The apparatus for processing string materials as set forth in claim 1, wherein said at least one first and/or second string material guiding means, particularly said at least one first and/or second guiding elements, are made of at least one material from the group of materials including metals, metal alloys, plastics, fiber-reinforced plastics, carbon, cefflar, composite materials, synthetic and natural resins, optical fibers, etc.

17. The apparatus for processing string materials as set forth in claim 1, wherein an angle between said at least one path of movement and said at least one second string material guiding means can be changed.

18. The apparatus for processing string materials as set forth in claim 1, wherein at least one said guiding element of said at least one second string material guiding means includes a first rotationally positioned body comprising at least one inlet and one outlet area and further two other rotationally positioned inner guiding elements arranged within said first body.

19. The apparatus for processing string materials as set forth in claim 1, wherein said at least one path of movement is between said inlet and outlet of said second string material guiding means due to the arrangement of said inner guiding elements, wherein said string material is conveyed in alternating manner either above or below a preceding and following rotational axis of a guiding element.

20. A method for processing string materials, particularly electric conductors, comprising the following steps:

Conveying a string material along at least one path of movement to a processing means;

Impeding self-twisting of said string material about the longitudinal axis thereof by means of at least one first guiding element of a first string material guiding means;

Processing said string material by means of at least one second guiding element of a second string material guiding means which may be rotated about a first axis and may be of a given angle together with said at least one path of movement.

21. The method for processing string materials as set forth in claim 20, wherein said second string material guiding means includes a drive means for rotating said at least one second guiding element about said first axis.

22. The method for processing string materials as set forth in claim 1, wherein said at least one second guiding element of said second string material guiding means is rotated either continuously or intermittently.

23. The method for processing string materials as set forth in claim 1, wherein said rotation of said at least one second guiding element of said second string material guiding means is controlled in dependency of a conveying speed of the string material and/or a given backtwisting of said string material by means of a subsequently following process step.

24. The method for processing string materials as set forth in claim 1, wherein a distance between said first string material guiding means and said second string material guiding means is changed either continuously or intermittently.

* * * * *